United States Patent [19]

Yates

[11] Patent Number: 4,685,644

[45] Date of Patent: Aug. 11, 1987

[54] PROTECTIVE APPARATUS FOR ARTISTS

[76] Inventor: Roy E. Yates, Rte. 1, Box 80B, Angleton, Tex. 77515

[21] Appl. No.: 875,952

[22] Filed: Jun. 19, 1986

[51] Int. Cl.[4] ..... B43L 15/00

[52] U.S. Cl. ..... 248/118.3; 248/231.7

[58] Field of Search ..... 248/441.1, 118, 118.1, 248/118.3, 118.5, 231.7; 33/80; 108/31, 29; 434/85

[56] References Cited

U.S. PATENT DOCUMENTS

| | | | |
|---|---|---|---|
| 1,029,071 | 6/1912 | LePage | 248/231.7 X |
| 1,793,521 | 2/1931 | Sommers | 108/31 |
| 2,496,276 | 2/1950 | Dolas | 248/118 |
| 2,836,223 | 5/1958 | Kent | 248/231.7 X |
| 3,442,478 | 5/1969 | Parapetti | 248/231.7 X |
| 3,815,856 | 6/1974 | Cortimilia | 248/118 |
| 3,972,133 | 8/1976 | Parshall | 434/85 |
| 4,188,006 | 2/1980 | Karlin | 248/118.3 |

*Primary Examiner*—J. Franklin Foss

*Attorney, Agent, or Firm*—Bill B. Berryhill

[57] ABSTRACT

Apparatus for protecting the work of an artist being performed on canvas mounted on a canvas stretch frame including a mounting assembly by which the apparatus is attached to the canvas frame. A suspension member extends from the mounting assembly and a maulstick is supportable from a proximal end thereof by the suspension member. The maulstick may hang free of the work but is graspable at a distal end thereof for positioning across the work.

5 Claims, 4 Drawing Figures

PROTECTIVE APPARATUS FOR ARTISTS

BACKGROUND OF THE INVENTION

1. Field of the Invention

The present invention pertains to apparatus for protecting the work of an artist as the work is being performed on canvas. More specifically, the present invention pertains to apparatus for positioning across the work of an artist to protect the work from the artist's working hand.

2. Description of the Prior Art

Various devices have been developed for protecting the work of an artist as the work is being performed on canvas. Specifically, these devices are designed to protect wet paint or other artist mediums from the artist's working hand as the work is being performed on the canvas. Several of these devices are shown in U.S. Pat. Nos. 2,496,276; 3,101,568; 3,768,764; 3,815,856; 3,972,133 and 4,088,290. Most of these devices provide some kind of rod or stick, commonly called a maulstick, which may be positioned across the artist's work to prevent the artist's working hand from accidently engaging and disturbing the artist's work.

Some of these rods or maulsticks are attachable at both ends thereof to the frame of the canvas on which the work is being performed. See, for example, U.S. Pat. Nos. 2,496,276 and 4,088,290. This usually means that some type of attaching element or clamp must be disengaged each time it is necessary to reposition the maulstick. This is time consumming and sometimes quite cumbersome. Furthermore, each time a device such as this is disengaged, there is a possibility that the maulstick might accidently contact and disturb the work.

In other devices, such as U.S. Pat. Nos. 3,815,856 and 3,972,133, a maulstick is supported at one end by some sort of support attached to the canvas frame. The other end is supported by the artist's nonworking hand. However, these devices usually require disengagement of the maulstick at the supported end for repositioning. Furthermore, once disengaged or free from the support member, maulsticks in these devices may be misplaced or lost.

As can be seen, a number of solutions to the problem of protecting an artist's work have been attempted in these devices. However, a totally satisfactory solution is not found in the prior art.

SUMMARY OF THE PRESENT INVENTION

In the present invention, apparatus is provided for protecting an artist's work as it is being performed on canvas. The apparatus may include a mounting assembly for attaching the apparatus to the canvas frame. A suspension member extends from the mounting assembly and a maulstick is supported from a proximal end thereof by the suspension member. The suspension member may include a rod member extending outwardly from the mounting assembly and one end of the rod member may be adapted to receive the proximal end of the maulstick. The rod member is attached to the mounting assembly for rotation about an axis substantially perpendicular to the plane of the canvas. Thus, the maulstick, under its own weight, rotates the rod member, from which it is suspended, so as to hang free along side of the frame when not being used. However, the maulstick is graspable at the distal end thereof by one hand of the artist for positioning across the work when needed.

The apparatus of the present invention is effective in protecting the artist's work. It hangs harmlessly out of the way when not needed. It is simple in operation and construction. Many other objects and advantages of the invention will be understood from reading the description which follows in conjunction with the accompanying drawings.

DESCRIPTION OF A PREFERRED EMBODIMENT

Figure 1:
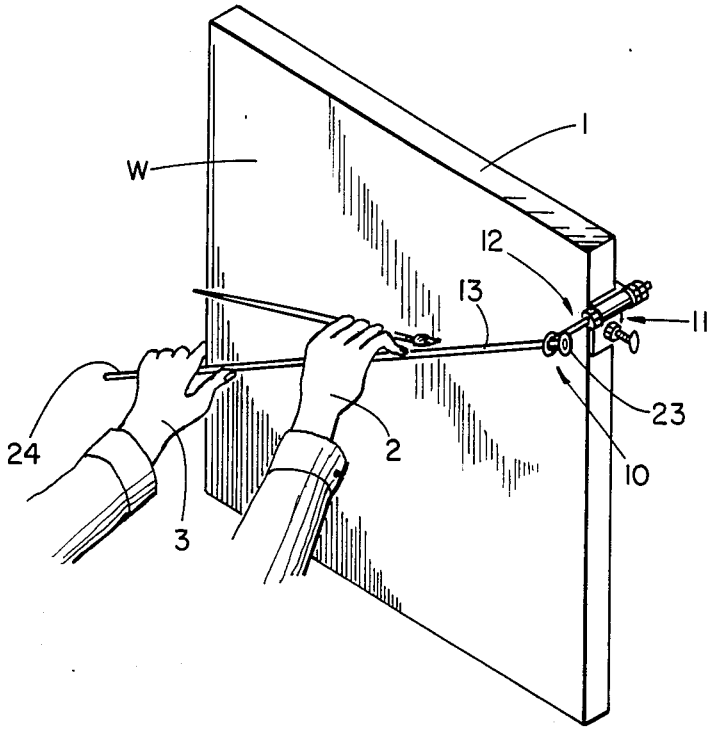
FIG. 1 a perspective view of a work of art being performed on canvas and illustrating use of the protective apparatus of the present invention, according to a preferred embodiment thereof.

Referring first to FIG. 1, there is shown the work W of an artist being performed on canvas mounted on a canvas stretch frame 1. Apparatus, generally referenced 10, is provided for protecting the artist's work W from the artist's working hand 2 as the work is being performed. This protective apparatus 10 includes a mounting assembly 11, suspension means 12 and a maulstick 13.

Figure 2:
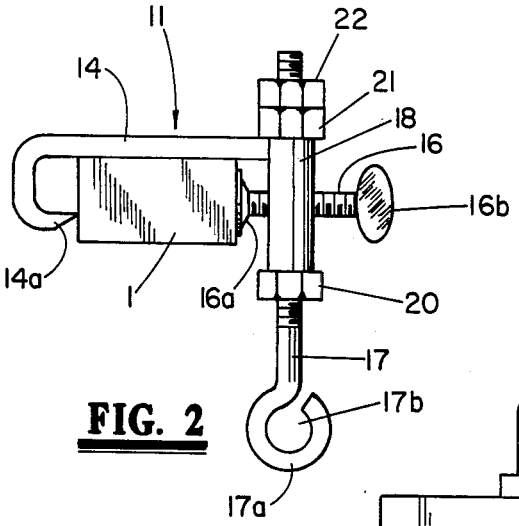
FIG. 2 is a top view of clamp and suspension members of the protective apparatus of the present invention; according to a preferred embodiment thereof.
Figure 3:
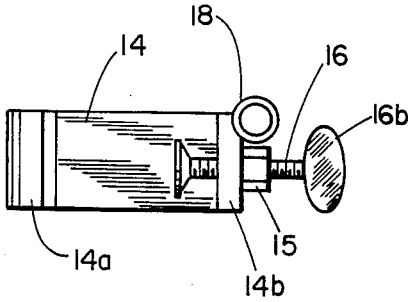
FIG. 3 is a side view of the clamp and suspension members of FIG. 2; and, FIG. 4 is an elevation view of an easel, with an artist's work thereon, illustrating the protective apparatus of the present invention hanging in an inactive position.

Referring also to FIGS. 2 and 3, the mounting assembly 11 includes a channel shaped portion or clamp 14, one end 14*a* of which may be adapted to engage the side of the frame 1 and an opposite portion 14*b* of which may be drilled and tapped or provided with a nut 15 through which a screw member 16 may pass. The screw member 16 may be provided with a frame engaging pad 16*a* and a finger engageable key portion 16*b*. With the clamp 14 in the position shown in FIG. 2, the screw 16 may be tightened so that the apparatus 10 is firmly attached to the frame 1. Conversely, loosening of the screw 16 would allow removal of the apparatus from the frame 1.

The suspension means 12 includes a rod member 17 which is rotatingly mounted in a cylindrical member 18 attached to the clamp 14. The rod member 17 may be threaded to receive nuts 20, 21 and 22, holding the rod 17 in place so as to extend outwardly from the mounting assembly 11, the frame 1 and the work W when the clamp 14 is in proper position. The rod member 17 is provided at one end thereof with a loop 17*a* the opening 17*b* of which is adapted to receive the elongated maulstick 13.

The maulstick 13 is an elongated member, the proximal end 23 of which is enlarged. Thus, the maulstick 13 may be slipped through the opening 17*b* of the rod loop 17*a* from its distal end 24. However, since the proximal end 23 is larger than the opening 17*b*, the maulstick can pass no further through the loop 17*a*. Thus, it is suspended or supported from its proximal end by the rod member 12.

Figure 4:
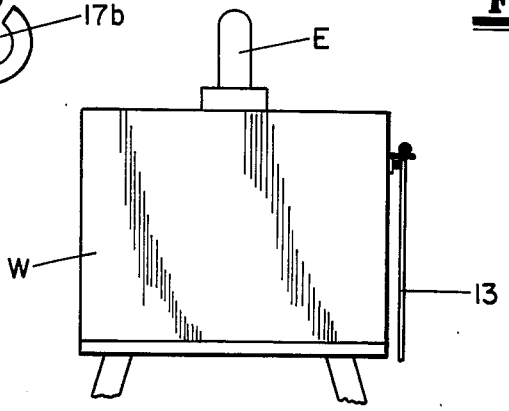

In FIG. 4, the work W is shown supported on as easel E. It will be noted that the maulstick 13, due to the rotatability of rod member 17, under the influence of its own weight hangs free alongside the work W and clear thereof. However, as shown in FIG. 1, the distal end 24 of the maulstick 13 is graspable by the non-working hand 3 of the artist so as to position the maulstick 13 across the work W to protect the work W from the artist's working hand 2. When work is interrupted, the maulstick 13 can be released by the hand 3 so that the maulstick again falls to the free hanging position of FIG. 4, out of the way of the work W. While it is most likely that the clamp member 11 will remain in a single fixed position as the work W is completed, it could be moved anywhere on the frame 1 if desired.

Thus, the apparatus of the present invention is very effective in protecting the work of an artist. It will not slip. When not in use, the maulstick hangs neatly out of the way, freeing the artist's hands for holding brushes, palettes, etc. Furthermore, the apparatus of the present invention is easy to use, of simple construction and relatively inexpensive.

A single embodiment of the invention has been described herein. However, several variations of the invention may be made by those skilled in the art without departing from the spirit of the invention. For example, many artists work on illustration board, masonite panels, paper mounted on drafting boards, etc. While the invention has been described for use with canvas stretched on a canvas frame it can easily be adapted to these also. Thus, when the term "canvas" and "canvas frame" is used herein and in the claims it is intended to cover any surface and its support on which the art work is performed. Accordingly, it is intended that the scope of the invention be limited only by the claims which follow.

I claim:

1. Apparatus for protecting the work of an artist as work is being performed on canvas or other work surface mounted on a canvas frame or other support, said apparatus comprising:

mounting means for attaching said apparatus to said frame of support;

suspension means extending outwardly from said mounting means and including a rod member which is rotatable about an axis substantially perpendicular to the plane of said canvas or work surface; and a maulstick supportable from a proximal end thereof by said suspension means to hang free of said work, but graspable at the distal end thereof by one hand of the artist for rotating said rod and positioning said maulstick across said work to protect said work from the artist's working hand.

2. Apparatus as set forth in claim 1 in which said rod member is rotatable under the influence of the weight of said maulstick to automatically support said maulstick alongside of said frame or support and free of said work when being used.

3. Apparatus as set forth in claim 1 in which said one end of said rod member comprises a loop through the opening of which said maulstick may be passed for support at the proximal end thereof, said proximal end of said maulstick having an enlarged portion thereon to prevent further passage through said loop.

4. Apparatus as set forth in claim 3 in which said maulstick comprises an elongated member said enlarged proximal end of which comprises a loop which is larger than said opening of said rod member.

5. Apparatus as set forth in claim 1 in which said mounting means comprises a clamp portion positionable on said frame and a screw member, rotation of which tightens said clamp portion on said frame.

* * * * *